US008061064B2

(12) United States Patent
Ollinger, IV et al.

(10) Patent No.: US 8,061,064 B2
(45) Date of Patent: Nov. 22, 2011

(54) WEAR ASSEMBLY FOR EXCAVATING EQUIPMENT

(75) Inventors: Charles G. Ollinger, IV, Portland, OR (US); Chris D. Snyder, Portland, OR (US); John S. Kreitzberg, Portland, OR (US)

(73) Assignee: ESCO Corporation, Portland, OR (US)

( * ) Notice: Subject to any disclaimer, the term of this patent is extended or adjusted under 35 U.S.C. 154(b) by 0 days.

(21) Appl. No.: 12/613,467

(22) Filed: Nov. 5, 2009

(65) Prior Publication Data

US 2011/0232139 A9 Sep. 29, 2011

Related U.S. Application Data

(63) Continuation of application No. PCT/US2008/062724, filed on May 6, 2008.

(60) Provisional application No. 60/930,483, filed on May 15, 2007, provisional application No. 60/928,780, filed on May 10, 2007, provisional application No. 60/928,821, filed on May 10, 2007.

(51) Int. Cl.
*E02F 9/28* (2006.01)

(52) U.S. Cl. ..... 37/453

(58) Field of Classification Search ..... 37/446–460; 172/701.1, 701.3, 713, 719, 721, 749, 772.5
See application file for complete search history.

(56) References Cited

U.S. PATENT DOCUMENTS

| | | | | |
|---|---|---|---|---|
| 784,116 | A | 3/1905 | McCaskey | |
| 1,218,841 | A | 3/1917 | Dietz | |
| 1,438,001 | A * | 12/1922 | Van Buskirk et al. | 37/454 |
| 2,040,085 | A * | 5/1936 | Fykse et al. | 37/452 |
| 2,050,014 | A * | 8/1936 | Morrison | 37/454 |
| 2,167,425 | A | 7/1939 | Page | |
| 2,689,419 | A | 9/1954 | Daniels et al. | |
| 2,738,602 | A | 3/1956 | Meeks | |
| 2,874,491 | A | 2/1959 | Larsen | |
| 2,904,909 | A * | 9/1959 | Ratkowski | 37/458 |
| 2,915,290 | A | 12/1959 | Petersen | |
| 2,919,506 | A * | 1/1960 | Larsen | 37/457 |
| 3,012,346 | A * | 12/1961 | Larsen | 37/457 |
| 3,079,710 | A | 3/1963 | Larsen et al. | |
| 3,331,637 | A | 7/1967 | Krekeler | |
| 3,455,040 | A * | 7/1969 | Ratkowski | 37/456 |
| 3,530,601 | A * | 9/1970 | Steil | 37/456 |
| 3,623,247 | A * | 11/1971 | Stepe | 37/455 |
| 3,774,324 | A | 11/1973 | Lafond | |
| 3,897,642 | A * | 8/1975 | Helton et al. | 37/458 |
| 3,959,901 | A * | 6/1976 | Klett | 37/452 |
| 3,982,339 | A | 9/1976 | Nilsson | |

(Continued)

FOREIGN PATENT DOCUMENTS

| | | |
|---|---|---|
| JP | 61176724 | 8/1986 |

(Continued)

*Primary Examiner* — Robert Pezzuto
(74) *Attorney, Agent, or Firm* — Steven P. Schad

(57) ABSTRACT

A wear assembly for excavating equipment includes a base fixed to the excavating equipment, a wear member fit over the base, and a lock to releasably hold the wear member to the base. The wear member includes side relief to reduce drag on the system. The wear member and the base each includes a hemispherical front end and a generally trapezoidal rear portion. The base includes a nose and a stop projecting from the nose to cooperate with the lock without an opening being needed to receive the lock into the nose. The lock is an elongate lock positioned generally in an axial direction and which holds the wear member to the base under compressive loads.

44 Claims, 13 Drawing Sheets

U.S. PATENT DOCUMENTS

| | | | | | |
|---|---|---|---|---|---|
| 4,027,408 | A | | 6/1977 | Ramella et al. | |
| 4,317,300 | A | | 3/1982 | Emrich et al. | |
| 4,319,415 | A | | 3/1982 | Mayerbock et al. | |
| 4,335,532 | A | | 6/1982 | Hahn et al. | |
| 4,404,760 | A | | 9/1983 | Hahn et al. | |
| D274,434 | S | | 6/1984 | Nilsson | |
| 4,470,210 | A | | 9/1984 | Hahn | |
| D275,859 | S | | 10/1984 | Nilsson | |
| 4,481,728 | A | * | 11/1984 | Mulder et al. | 37/452 |
| 4,510,706 | A | | 4/1985 | Berchem | |
| 4,577,423 | A | | 3/1986 | Hahn | |
| 4,611,418 | A | | 9/1986 | Launder | |
| 4,625,439 | A | * | 12/1986 | Johansson et al. | 37/456 |
| 4,727,663 | A | * | 3/1988 | Hahn | 37/458 |
| 4,744,692 | A | | 5/1988 | Olsen et al. | |
| 4,751,785 | A | * | 6/1988 | Johansson et al. | 37/459 |
| 5,074,062 | A | | 12/1991 | Hahn et al. | |
| 5,152,088 | A | | 10/1992 | Hahn | |
| 5,177,886 | A | | 1/1993 | Klett | |
| 5,350,022 | A | | 9/1994 | Launder et al. | |
| D354,291 | S | | 1/1995 | Edwards | |
| 5,653,048 | A | | 8/1997 | Jones et al. | |
| D389,844 | S | | 1/1998 | Moreno | |
| D414,193 | S | | 9/1999 | Launder et al. | |
| D417,877 | S | | 12/1999 | Launder et al. | |
| 6,047,487 | A | | 4/2000 | Clendenning | |
| 6,240,663 | B1 | | 6/2001 | Robinson | |
| 6,247,255 | B1 | | 6/2001 | Clendenning | |
| D446,224 | S | | 8/2001 | Clendenning | |
| D447,154 | S | | 8/2001 | Clendenning | |
| 6,321,471 | B2 | | 11/2001 | Fernandez et al. | |
| 6,393,739 | B1 | | 5/2002 | Shamblin et al. | |
| 6,430,851 | B1 | | 8/2002 | Clendenning | |
| 6,439,796 | B1 | | 8/2002 | Ruvang et al. | |
| 6,477,796 | B1 | * | 11/2002 | Cornelius | 37/452 |
| 6,675,509 | B2 | | 1/2004 | Bierwith | |
| 6,729,052 | B2 | | 5/2004 | Ollinger, IV et al. | |
| 6,735,890 | B2 | | 5/2004 | Carpenter et al. | |
| 6,745,503 | B1 | | 6/2004 | Pallas Moreno et al. | |
| 6,836,983 | B2 | | 1/2005 | Pallas Moreno et al. | |
| 6,839,990 | B2 | | 1/2005 | Leslie et al. | |
| 6,865,828 | B1 | * | 3/2005 | Molino et al. | 37/454 |
| 6,976,325 | B2 | | 12/2005 | Robinson et al. | |
| 7,523,572 | B2 | * | 4/2009 | Pasqualini | 37/456 |
| 7,730,651 | B2 | * | 6/2010 | Carpenter | 37/452 |
| 2001/0001352 | A1 | | 5/2001 | Fernandez et al. | |
| 2003/0005606 | A1 | | 1/2003 | Carpenter et al. | |
| 2003/0024139 | A1 | | 2/2003 | Jones et al. | |
| 2003/0101627 | A1 | | 6/2003 | Robinson et al. | |
| 2004/0093771 | A1 | | 5/2004 | Carpenter et al. | |
| 2004/0118021 | A1 | | 6/2004 | Renski | |
| 2005/0050775 | A1 | | 3/2005 | Clendenning et al. | |
| 2005/0055853 | A1 | | 3/2005 | Livesay et al. | |
| 2005/0120596 | A1 | | 6/2005 | Kasim | |
| 2005/0132619 | A1 | | 6/2005 | Robinson | |
| 2006/0013648 | A1 | | 1/2006 | Bernstein | |
| 2007/0227051 | A1 | * | 10/2007 | Carpenter et al. | 37/452 |
| 2008/0000114 | A1 | * | 1/2008 | Bentley | 37/457 |

FOREIGN PATENT DOCUMENTS

| | | | |
|---|---|---|---|
| JP | 04306329 | A | 10/1992 |
| JP | 10183698 | A | 7/1998 |
| WO | WO 8703316 | A1 | 6/1987 |
| WO | WO 2004035945 | A1 | 4/2004 |

* cited by examiner

WEAR ASSEMBLY FOR EXCAVATING EQUIPMENT

This application is a continuation of international application PCT/US2008/062724 filed May 6, 2008, which claims the benefit of provisional applications U.S. Patent Application No. 60/928,780 filed May 10, 2007, U.S. Patent Application No. 60/928,821 filed May 10, 2007, and U.S. Patent Application No. 60/930,483 filed May 15, 2007.

FIELD OF THE INVENTION

The present invention pertains to a wear assembly for securing a wear member to excavating equipment, and in particular to a wear assembly that is well suited for attachment and use on a dredge cutterhead.

BACKGROUND OF THE INVENTION

Dredge cutterheads are used for excavating earthen material that is underwater, such as a riverbed. In general, a dredge cutterhead 1 includes several arms 2 that extend forward from a base ring 3 to a hub 4 (FIG. 21). The arms are spaced about the base ring and formed with a broad spiral about the central axis of the cutterhead. Each arm 2 is provided with a series of spaced apart teeth 5 to dig into the ground. The teeth are composed of adapters or bases 6 that are fixed to the arms, and points 7 that are releasably attached to the bases by locks 8.

In use, the cutterhead is rotated about its central axis to excavate the earthen material. A suction pipe is provided near the ring to remove the dredged material. To excavate the desired swath of ground, the cutterhead is moved side-to-side as well as forward. On account of swells and other movement of the water, the cutterhead also tends to move up and down, and periodically impact the bottom surface. Further difficulties are caused by the operator's inability to see the ground that is being excavated underneath the water; i.e., unlike most other excavating operations, the dredge cutterhead cannot be effectively guided along a path to best suit the terrain to be excavated. In view of the heavy loads and severe environment, the point and base interconnection needs to be stable and secure.

The cutterheads are rotated such that the teeth are driven into and through the ground at a rapid rate. Consequently, considerable power is needed to drive the cutterhead, particularly when excavating in rock. In an effort to minimize the power requirements, dredge points are typically provided with elongate, slender bits for easier penetration of the ground. However, as the bit becomes shorter due to wear, the mounting sections of the points will begin to engage the ground in the cutting operation. The mounting section is wider than the bit and is not shaped for reduced drag. On account of the resulting increased drag the mounting sections impose on the cutterhead, the points are usually changed at this time before the bits are fully worn away.

SUMMARY OF THE INVENTION

In accordance with one aspect of the invention, a wear member for excavating equipment is formed with side relief in the working and mounting sections to minimize the drag associated with the digging operation and, in turn, minimize the power needed to drive the equipment. Reduced power consumption, in turn, leads to a more efficient operation and a longer usable life for the wear member.

In accordance with the invention, the wear member has a transverse configuration where the width of the leading side is larger than the width of the corresponding trailing side so that the sidewalls of the wear member follow in the shadow of the leading side to decrease drag. This use of a smaller trailing side is provided not only through the working end but also at least partially into the mounting end. As a result, the drag experienced by a worn wear member of the invention is less than that of a conventional wear member. Less drag translates into less power consumption and a longer use of the wear member before it needs to be replaced. Accordingly, the working ends of the wear member can be further worn away before replacement is needed.

In accordance with another aspect of the invention, the wear member has a digging profile that is defined by the transverse configuration of that portion of the wear member that penetrates the ground in one digging pass and in the direction of motion through the ground. In one other aspect of the present invention, side relief in the wear member is provided in the digging profile to lessen the drag experienced during a digging operation. In a preferred embodiment, side relief is provided in every digging profile expected through the life of the wear member including those which encompass the mounting section.

In another aspect of the invention, the wear member includes a socket for receiving a nose of a base fixed to the excavating equipment. The socket is formed with a generally trapezoidal transverse shape that generally corresponds to the transverse trapezoidal exterior profile of the wear member. This general matching of the socket to the exterior of the mounting section eases manufacture, maximizes the size of the nose, and enhances the strength to weight ratio.

In a preferred construction, one or more of the top, bottom or side surfaces of a trapezoidal shaped nose and the corresponding walls of the socket are each bowed to fit together. These surfaces and walls have a gradual curvature to ease installation, enhance stability of the wear member, and resist rotation of the wear member about the longitudinal axis during use.

In accordance with another aspect of the invention, the socket and nose each includes rear stabilizing surfaces that extend substantially parallel to the longitudinal axis of the wear member and substantially around the perimeter of the socket and nose to resist rearward loads applied in all directions.

In accordance with another aspect of the invention, the socket and nose are formed with complementary front bearing faces that are substantially hemispherical to lessen stress in the components and to better control the rattle that occurs between the wear member and the base.

In another aspect of the invention, the socket and nose are formed with front curved bearing faces at their front ends, and with generally trapezoidal transverse shapes rearward of the front ends to improve stability, ease manufacture, maximize the size of the nose, reduce drag, stress and wear, and enhance the strength to weight ratio.

In accordance with another aspect of the invention, the wear assembly includes a base, a wear member that mounts to the base, and an axially oriented lock that in a compressive state holds the wear member to the base in a manner that is secure, easy to use, readily manufactured, and can tighten the fit of the wear member on the base. In one preferred embodiment, the wear assembly includes an adjustable axial lock.

In another aspect of the invention, the wear member includes an opening into which the lock is received, and a hole that is formed in a rear wall of the opening to accommodate passage of a lock to stabilize the lock and facilitate easy tightening of the lock.

In another aspect of the invention, the base interacts with the lock solely through the use of a projecting stop. As a result, there is no need for a hole, recess or passage in the nose such as is typically provided to receive the lock. The nose strength is thus enhanced.

In another aspect of the invention, the locking arrangement for securing the wear member to the base can be adjusted to consistently apply a predetermined tightening force to the wear member irrespective of the amount of wear that may exist in the base and/or wear member.

In another aspect of the invention, the wear member includes a marker that can be used to identify when the lock has been adequately tightened.

In another aspect of the invention, the wear member is installed and secured to the base through an easy to use, novel process involving an axial lock. The wear member fits over a nose of a base fixed to the excavating equipment. The base includes a stop that projects outward from the nose. An axial lock is received into an opening in the wear member and extends between the stop and a bearing surface on the wear member to releasably hold the wear member to the nose.

In another aspect of the invention, the wear member is first slid over a base fixed to the excavating equipment. An axially oriented lock is positioned with one bearing face against a stop on the base and another bearing face against a bearing wall on the wear member such that the lock is in axial compression. The lock is adjusted to move the wear member tightly onto the base.

In another aspect of the invention, a lock to releasably hold a wear member to a base includes a threaded linear shaft, with a bearing end and a tool engaging end, a nut threaded onto the shaft, and a spring including a plurality of alternating annular elastomeric disks and annular spacers fit about the threaded shaft between the bearing end and the nut.

BRIEF DESCRIPTION OF THE DRAWINGS

FIG. 8 is a cross-sectional view taken along line 8-8 in. FIG. 2.

DETAILED DESCRIPTION OF THE PREFERRED EMBODIMENTS

The present invention pertains to a wear assembly 10 for excavating equipment, and is particularly well suited for dredging operations. In this application, the invention is described in terms of a dredge tooth adapted for attachment to a dredge cutterhead. Nevertheless, the different aspects of the invention can be used in conjunction with other kinds of wear assemblies (e.g., shrouds) and for other kinds of excavating equipment (e.g., buckets).

Figure 1:
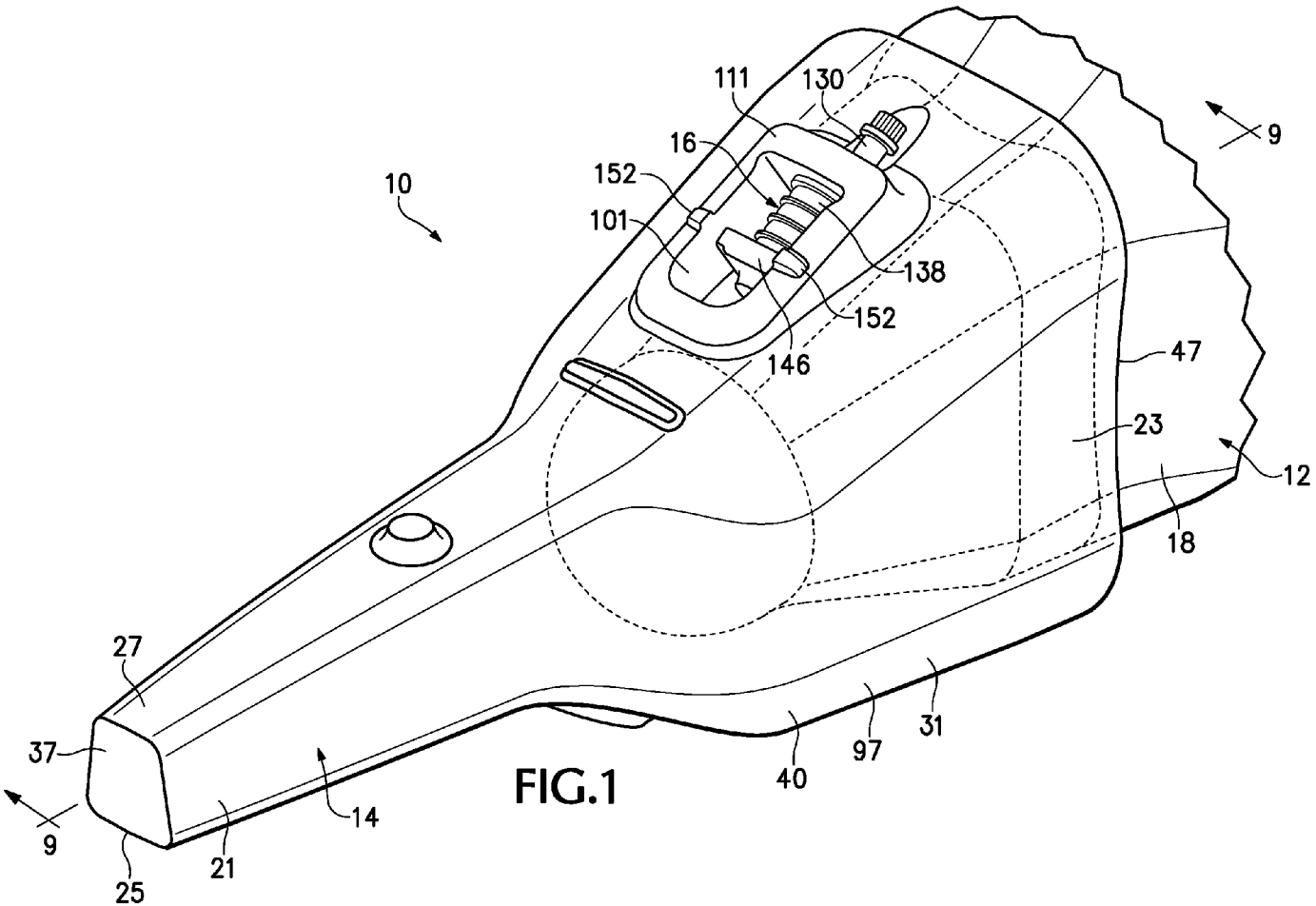
FIG. 1 is a wear assembly in accordance with the present invention.

The assembly is at times described in relative terms such as up, down, horizontal, vertical, front and rear; such terms are not considered essential and are provided simply to ease the description. The orientation of a wear member in an excavating operation, and particularly in a dredge operation, can change considerably. These relative terms should be understood with reference to the orientation of wear assembly 10 as illustrated in FIG. 1 unless otherwise stated.

Wear assembly 10 includes a base 12 secured to a dredge cutterhead, a wear member 14, and a lock 16 to releasably hold the wear member to base 12 (FIGS. 1-10).

Base 12 includes a forwardly projecting nose 18 onto which wear member 14 is mounted, and a mounting end (not shown) that is fixed to an arm of a dredge cutterhead (FIGS. 1, 9 and 11-14). The base may be cast as part of the arm, welded to the arm, or attached by mechanical means. As examples only, the base may be formed and mounted to the cutterhead such as disclosed in U.S. Pat. No. 4,470,210 or U.S. Pat. No. 6,729,052.

Figure 3:
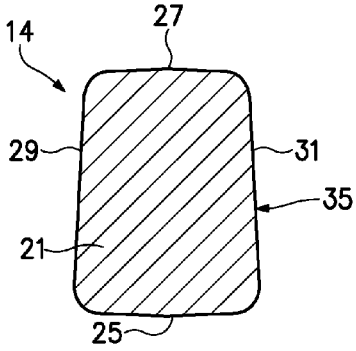
FIG. 3 is a cross-sectional view taken along line 3-3 in FIG. 2.
Figure 4:
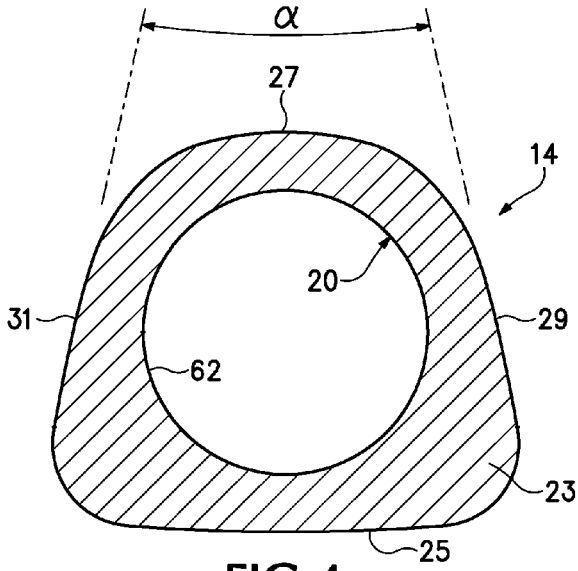
FIG. 4 is a cross-sectional view taken along line 4-4 in FIG. 2.
Figure 5:
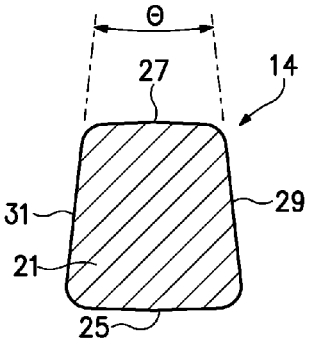
FIG. 5 is a cross-sectional view taken along line 5-5 in FIG. 2.
Figure 6:
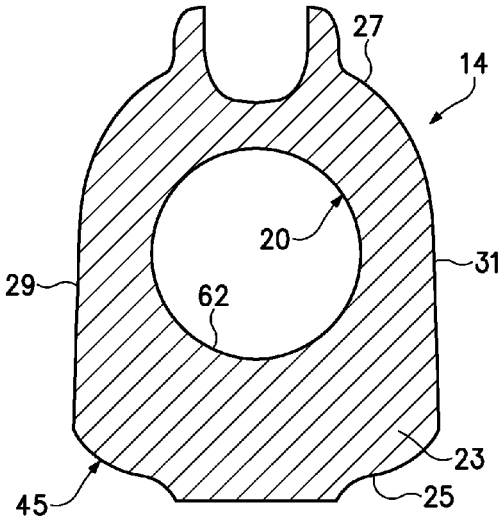
FIG. 6 is a cross-sectional view taken along line 6-6 in FIG. 2.
Figure 7:
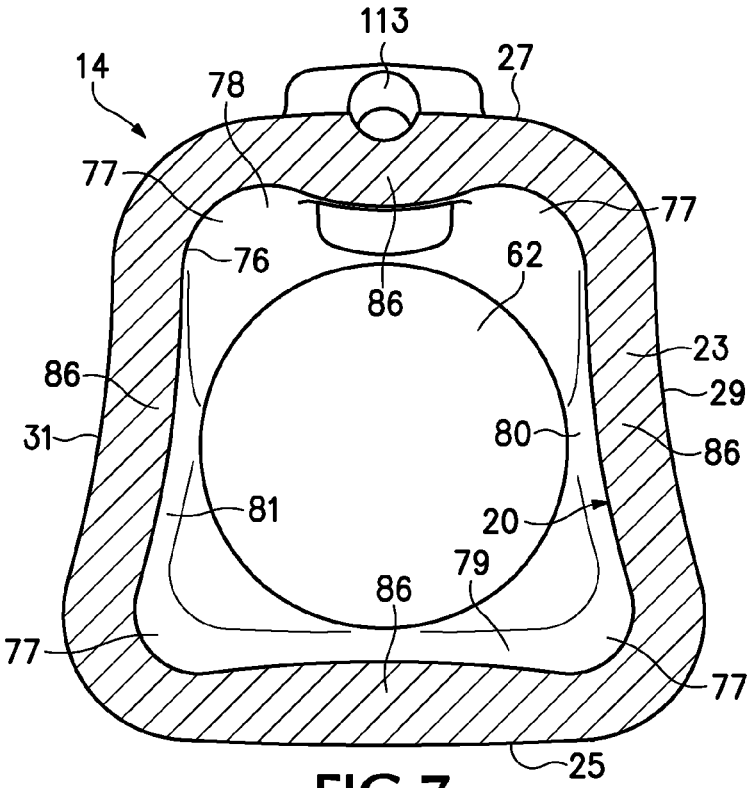
FIG. 7 is a cross-sectional view taken along line 7-7 in FIG. 2.
Figure 8:
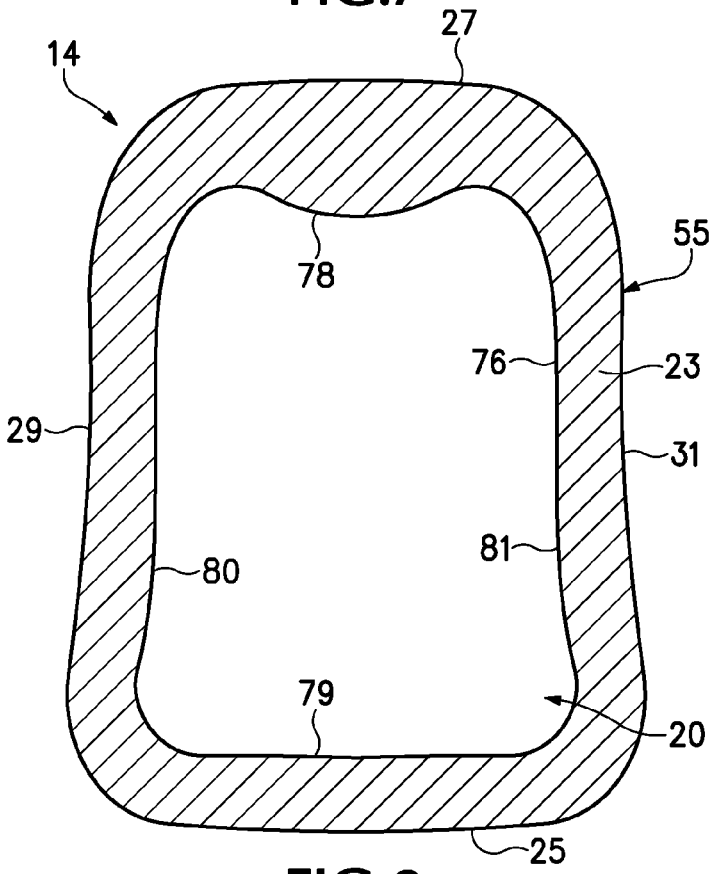

In a dredge tooth, wear member 14 is a point provided with a working section 21 in the form of an elongate slender bit and a mounting section 23 that defines a socket 20 to receive nose 18 (FIGS. 1-10). Point 14 is rotated by the cutterhead such that it engages the ground in generally the same way with each digging pass. As a result, point 14 includes a leading side 25 and a trailing side 27. Leading side 25 is the side that first engages and leads the penetration of the ground with each rotation of the cutterhead. In the present invention, trailing side 27 has a smaller width than leading side 25 (i.e., along a plane perpendicular to the longitudinal axis 28 of point 14) through bit 21 (FIG. 5) and at least partially through mounting section 23 (FIG. 4). In a preferred embodiment, trailing side 27 has a smaller width than leading side 25 throughout the length of point 14 (FIGS. 4, 5 and 7).

Bit 21 of point 14 preferably has a generally trapezoidal transverse configuration with a leading side 25 that is wider than trailing side 27 (FIG. 5). The term "transverse configuration" is used to refer to the two-dimensional configuration along a plane perpendicular to the longitudinal axis 28 of wear member 14. On account of this narrowing of the point, sidewalls 29, 31 follow in the shadow of leading side 25 during digging and thereby create little drag on the cutting operation. In a preferred construction, sidewalls 29, 31 converge toward trailing side 27 at an angle θ of about 16 degrees (FIG. 5); however, other angular configurations are possible. The leading side 25, trailing side 27 and sidewalls 29, 31 can be planar, curved or irregular. Moreover, shapes other than trapezoidal can be used that provide side relief.

In use, dredge point 14 penetrates the ground to a certain depth with each digging pass (i.e., with each rotation of the cutterhead). During much of the point's useful life, the bit alone penetrates the ground. As one example, the ground level in one digging cycle extends generally along line 3-3 (FIG. 2) at the center point of a digging pass. Since only the bit penetrates the ground and the bit is relatively thin, the drag placed on the digging operation is within manageable limits. Nevertheless, with many teeth being constantly driven through the ground at a rapid rate, power requirements are always high and reducing the drag even in the bit is beneficial to the operation, especially when digging through rock.

In a preferred construction, sidewalls 29, 31 not only converge toward trailing side 27, but are configured so that the sidewalls lie within the shadow of the leading side 25 in the digging profile. The "digging profile" is used to mean the cross-sectional configuration of the portion of point 14 that penetrates the ground along a plane that is (i) parallel to the direction of travel 34 at the center point of a digging pass through the ground and (ii) laterally perpendicular to the longitudinal axis. The digging profile is a better indication of the drag to be imposed on the point during use than a true transverse cross section. The provision of side relief in the digging profile is dependent on the angle at which the sidewalls converge toward the trailing side and the axial slope or expansion of the point surfaces in a rearward direction. The intention is to provide a width that generally narrows from the leading side to the trailing side when considered from the perspective of the digging profile. Side relief in the digging profile preferably extends across the expected cutterhead digging angles, but benefit can still be obtained if such side relief exists in at least one digging angle. As one example only, the cross-sectional configuration illustrated in FIG. 3 represents one digging profile 35 for a portion of point 14 being driven through the ground. As can be seen, bit 21 is still provided with side relief even in the digging profile as sidewalls 29, 31 converge toward trailing side 27 for reduced drag.

As bit 21 wears away, the ground level gradually creeps rearward so that more rearward, thicker portions of the point 14 are pushed through the ground with each digging cycle. More power is therefore required to drive the cutterhead as the points wear. Eventually, enough of the bit wears away such that the mounting section 23 of the point 14 is being driven through the ground with each digging pass. In the present invention, the mounting section 23 continues to include side relief at least at the front end 40 of the mounting section (FIG. 4), and preferably throughout the mounting section (FIGS. 4 and 7). As seen in FIG. 4, mounting section 23 is larger than bit 21 to accommodate the receipt of nose 18 into socket 20 and to provide ample strength for the interconnection between point 14 and base 12. Sidewalls 29, 31 are inclined so as to converge toward trailing side 27. The inclination of sidewalls 29, 31 along line 4-4 is, in this one example, at an angle $\alpha$ of about 26 degrees (FIG. 4), but other inclinations can also be used. As discussed above, the desired side relief in the digging profile depends on the relation between the transverse inclination of the sidewalls and the axial expansion of the point.

Figure 2:
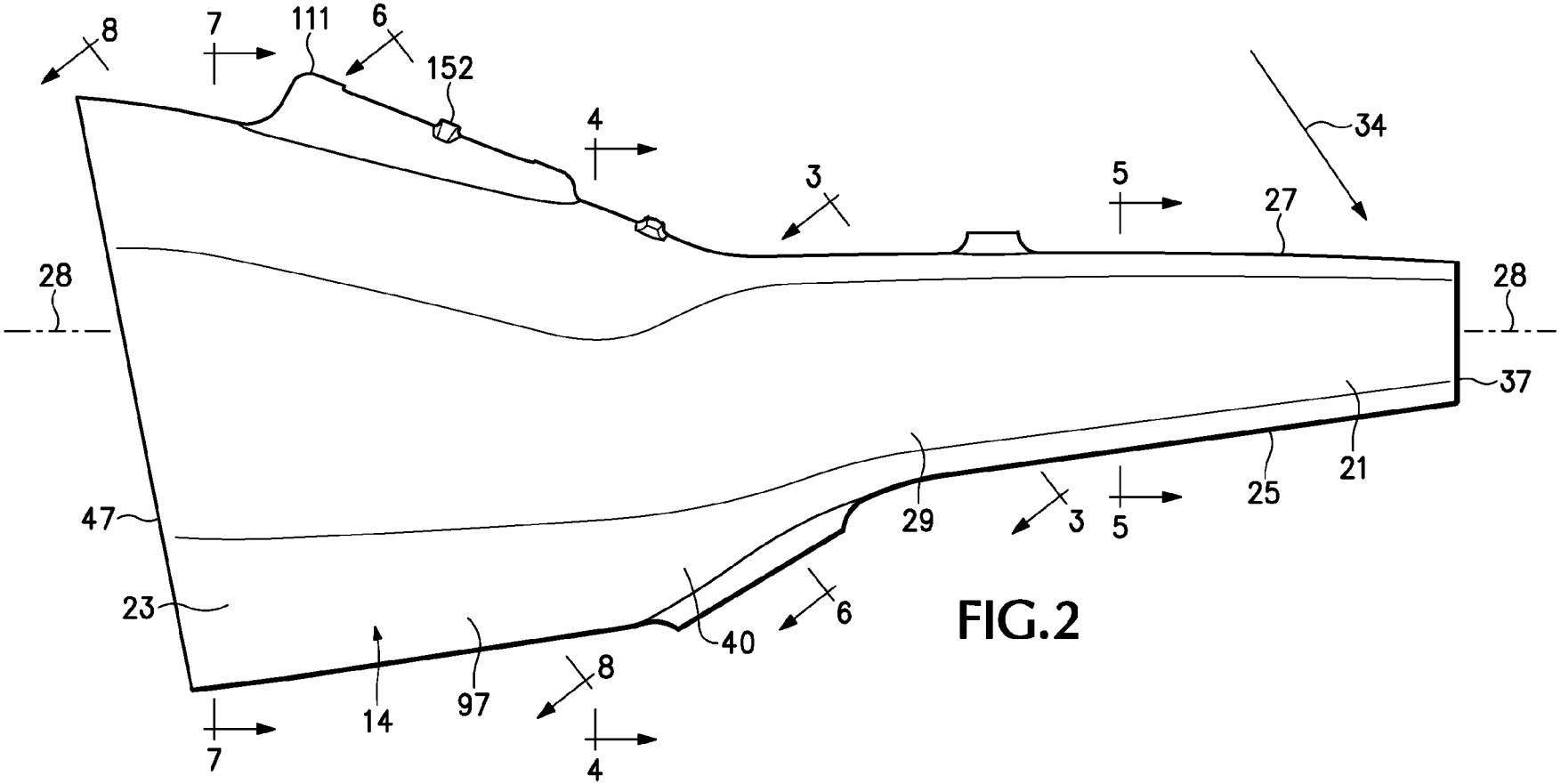
FIG. 2 is a side view of a wear member of the invention.
Figures 2A, 3A, 6A:
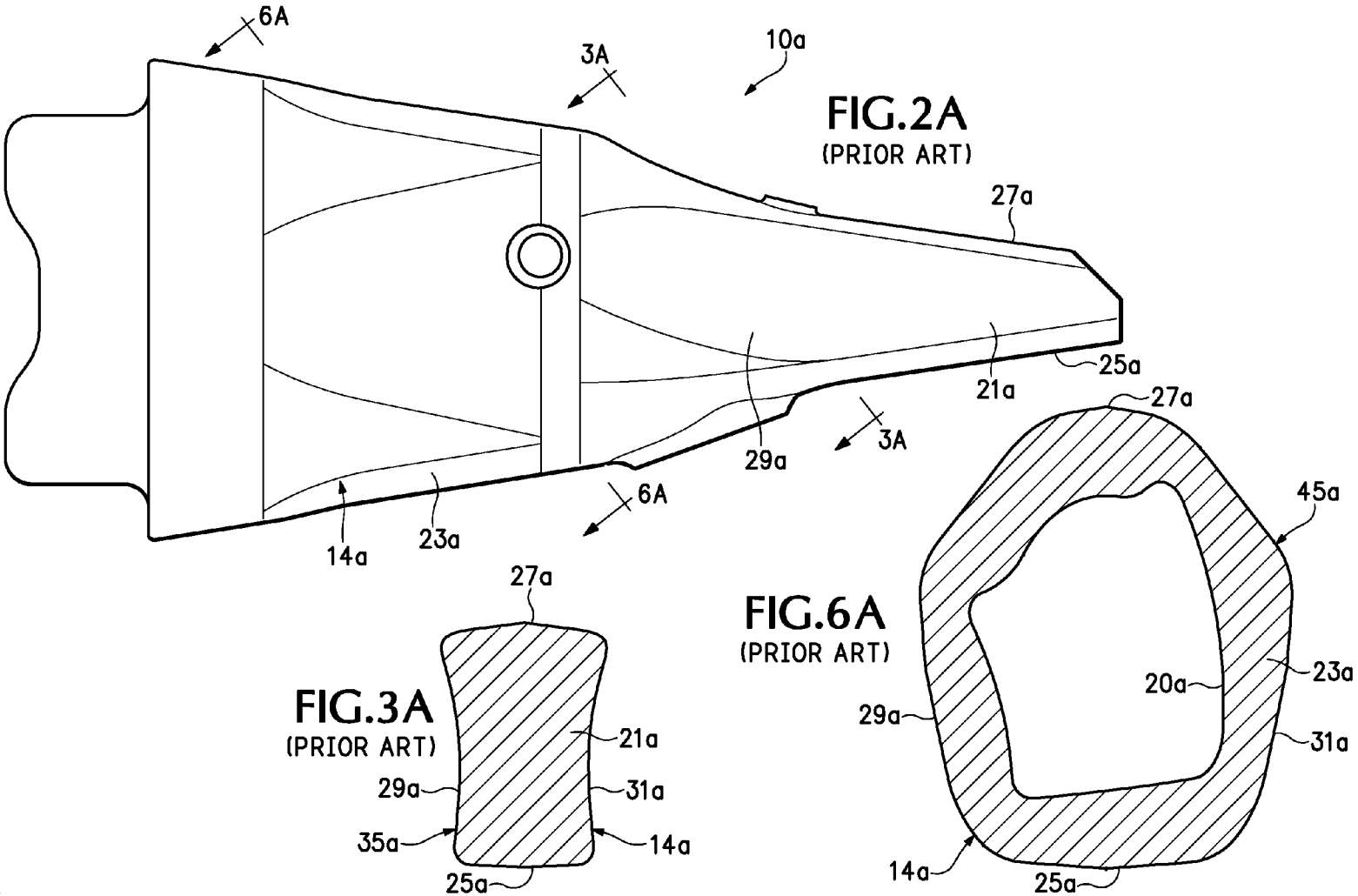
FIG.2A (PRIOR ART)
FIG.6A (PRIOR ART)
FIG.3A (PRIOR ART)
FIG. 2A is a side view of a conventional wear member.
FIG. 3A is a cross-sectional view taken along line 3A-3A in FIG. 2A.
FIG. 6A is the cross-sectional view taken along line 6A-6A in FIG. 2A.

In one conventional point 14*a*, bit 21*a* has a trapezoidal transverse configuration with a leading side 25*a* that is wider than trailing side 27*a*. However, bit 21*a* does not provide side relief in the digging profile. As seen in FIG. 3A, the digging profile 35*a* (i.e. along line 3A-3A) in FIG. 2A does not have sidewalls 29*a*, 31*a* that converge toward trailing side 27*a* (FIGS. 2A and 3A). Rather, sidewalls 29*a*, 31*a* in digging profile 35*a* expand outward at an increasingly greater slope as the sidewalls extend toward the trailing side. This outward flaring of sidewalls 29*a*, 31*a* will generate an increased drag on the cutterhead. The effective use of side relief in point 14 for the digging profile is a better reduction of drag than simply using sidewalls that convey in a transverse configuration.

In one other example, bit 21 has worn down to an extent where the portion of mounting section 23 along line 6-6 (FIGS. 2 and 6) is driven through the ground. Even the mounting section 23 provides side relief for reduced drag; i.e., sidewalls 29, 31 converge toward trailing side even in digging profile 45. The presence of side relief in digging profile 45 imposes less drag and, hence, requires less power to be driven through the ground. The reduced drag, in turn, enables the cutterhead to continue to operate with points worn to the point where the mounting section penetrates the ground. In conventional point 14*a*, mounting section 23*a* does not have a trapezoidal transverse configuration with sidewalls 29*a*, 31*a* that converge toward trailing side 27*a*. Moreover, as seen in FIG. 6A, sidewalls 29*a*, 31*a* diverge from leading side 25*a* in digging profile 45*a* taken along line 6*a*-6*a* encompassing the front end 40*a* of mounting section 23*a*. The lack of side relief in the digging profile imposes a heavy drag on the point 14*a* as it is driven through the ground especially as compared to the present inventive point 14. With the heavy drag produced by points 14*a* in this condition, many operators will replace the points when the mounting sections 23*a* begin to be driven through the ground even though bits 21*a* are not fully worn out. With the present invention, points 14 can stay on bases 12 until bits 21 are further worn out.

In a preferred construction, the tapering of sidewalls 29, 31 continues from front end 37 to rear end 47 of point 14. As seen in FIG. 7, sidewalls 29, 31 converge toward trailing side 27 even at the rear of mounting section 23. Moreover, side relief is provided even in a digging profile 55 along line 8-8 (FIGS. 2 and 8), i.e., sidewalls 29, 31 converge toward trailing side 27 even in this rearward digging profile 55.

The use of a point 14 with side relief in bit 21 and mounting end 23 as described above can be used with virtually any nose and socket configuration. Nonetheless, in one preferred construction, front end 58 of nose 18 includes a forward-facing bearing face 60 that is convex and curved about two perpendicular axes (FIGS. 1, 9 and 11-14). Likewise, the front end 62 of socket 20 is formed with a complementary concave and curved bearing face 64 to set against bearing face 60 (FIGS. 1, 7, 9 and 11). In the illustrated construction, front bearing faces 60, 64 each conforms to a spherical segment to lessen stress in the components due to the application of non-axial loads such as disclosed in U.S. Pat. No. 6,729,052, which is incorporated in its entirety herein by reference.

Figure 9:
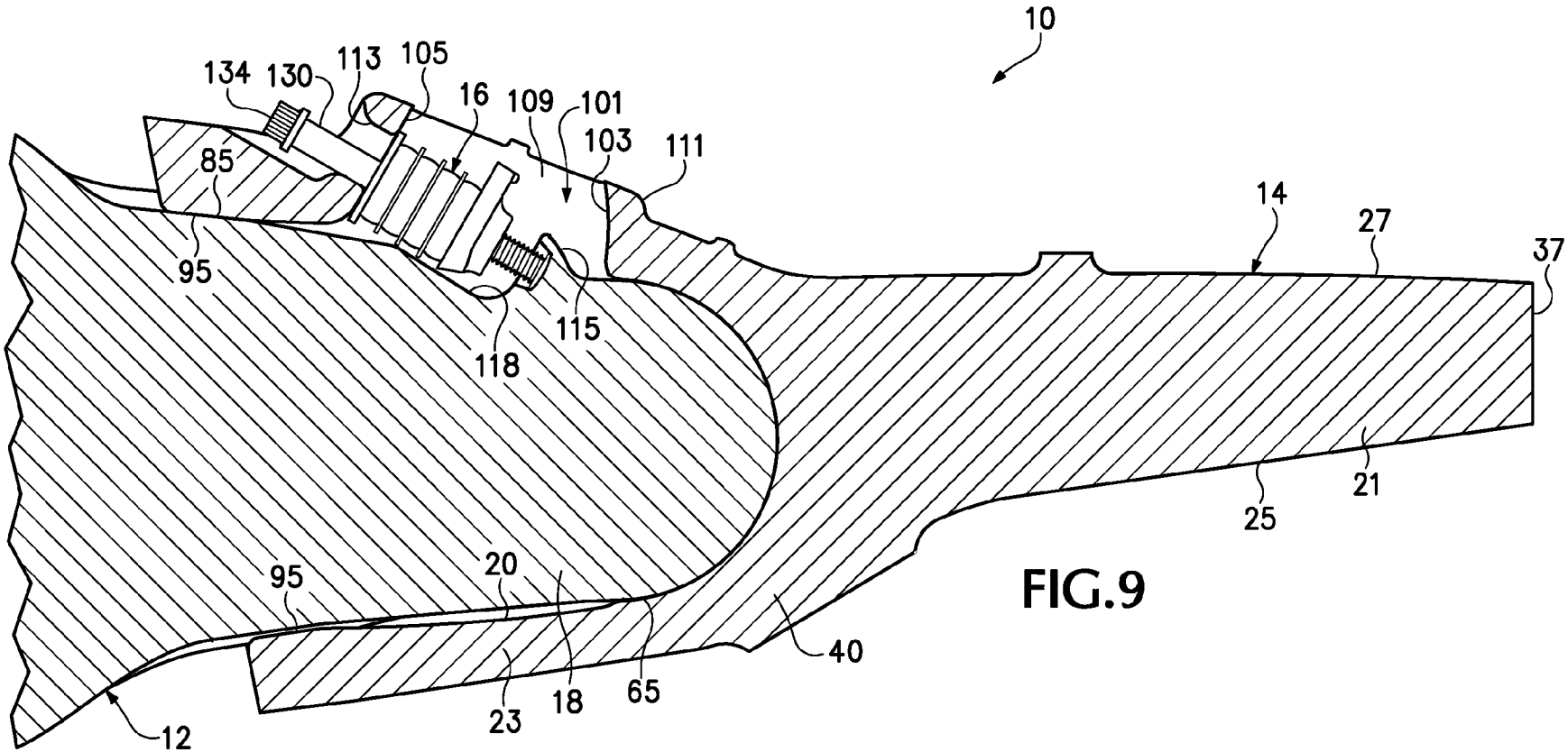
FIG. 9 is a cross-sectional view taken along line 9-9 in FIG. 1.
Figure 10:
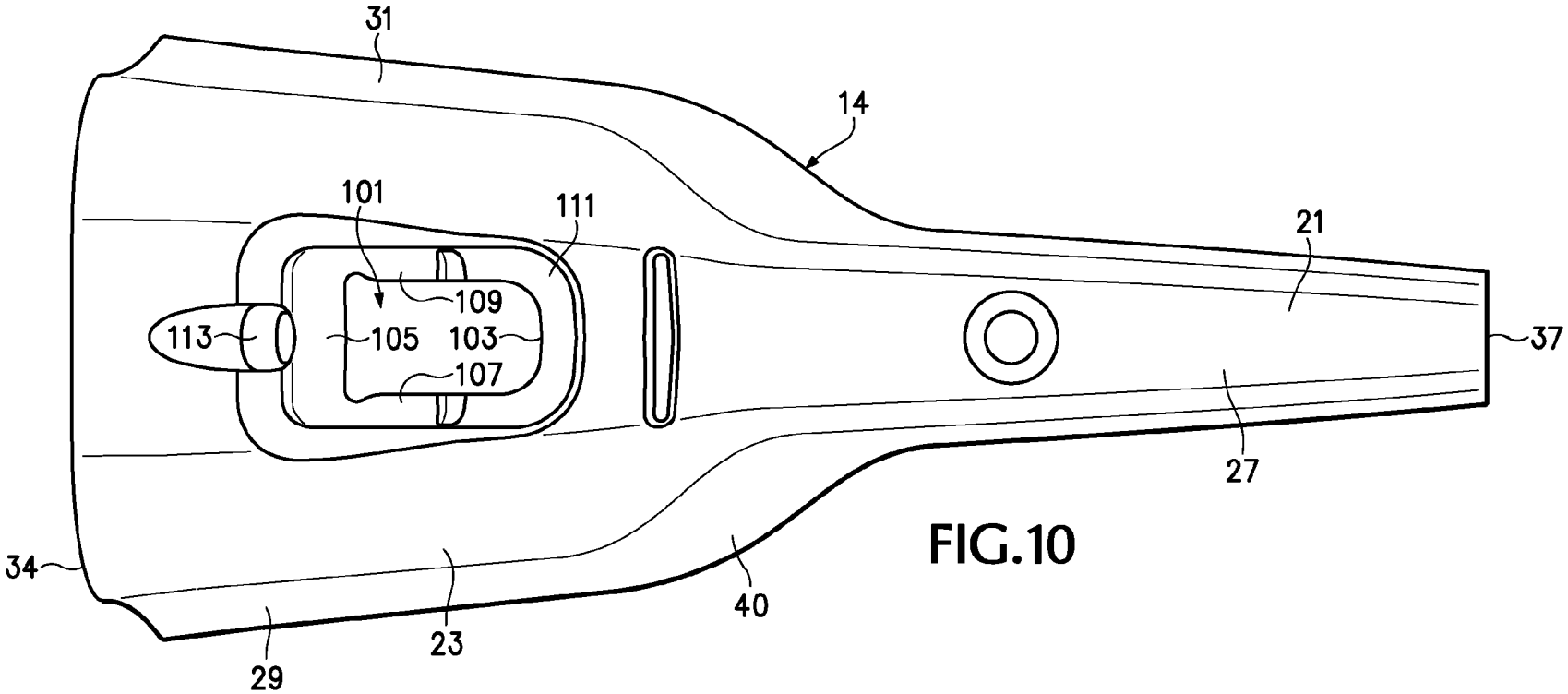
FIG. 10 is a top view of the wear member.

Preferably, front ends 58, 62 are each generally hemispherical to reduce the rattle between point 14 and base 12 and more effectively resist loads from all directions. Front bearing surface 64 of socket 20 is preferably slightly broader than hemispherical at its ends and center to accommodate reliably mounting of points 14 on different bases (i.e., without binding or bottoming out), but which under common loads or following wear operate as a true hemispherical socket surface on the hemispherical ball surface of base 12. In a conventional tooth 10*a* (FIG. 2A), the point shifts 14*a* around on the nose as the tooth is forced through the ground. The front ends of the socket and nose are angular with flat bearing surfaces and hard corners. During use, point 14*a* shifts around on the nose such that the front of the socket 20*a* rattles around and against the front end of the nose, and the rear end of the socket shifts around and rattles against the rear end of the nose. This shifting and rattling causes the point and base to wear. In the present invention, the use of generally hemispherical front bearing faces 60, 64 substantially reduces the rattle at the front end of the socket 20 and nose 18 (FIGS. 1 and 9). Rather, the use of smooth, continuous front bearing faces enables the point to roll about the nose to reduce wear. A small band 65, substantially parallel to the longitudinal axis 28, preferably extends directly rearward of the generally hemispherical bearing surfaces to provide additional capacity for the nose to wear and still maintain the desired support. The term "substantially parallel" is intended to include parallel surfaces as well as those that axially diverge rearwardly from axis 28 at a small angle (e.g., of about 1-7 degrees) for manufacturing or other purposes. The small band 65 Is preferably axially inclined no more than 5 degrees to axis 28, and most preferably is axially inclined about 2-3 degrees.

Nose 18 includes a body 66 rearward of front end 58 (FIGS. 11-14). Body 66 is defined by an upper surface 68, a lower surface 69 and side surfaces 70, 71. In a preferred construction, body surfaces 68-71 diverge rearwardly so that nose 18 expands outward from front end 58 to provide a more robust nose to withstand the rigors of digging. Nevertheless, it is possible for only the upper and lower surfaces 68, 69 to diverge from each other and for the side surfaces 70, 71 to axially extend substantially parallel to each other. Socket 20 has a main portion 76 rearward of front end 62 to receive body 66. Main portion 76 includes an upper wall 78, lower wall 79 and sidewalls 80, 81 that conform to body surfaces 68-71. In a preferred embodiment, body 66 and main portion 76 each have a trapezoidal transverse configuration. The use of a trapezoidal shape predominantly along the length of nose 18 and socket 20 provides four corners 67, 77, which act as spaced ridges to resist turning of wear member 14 about axis 28.

Also, in a preferred embodiment, at least one of the body surfaces 68-71 and socket walls 78-81 (and preferably all of them) have mutually bowed configurations (FIGS. 7, 11 and 13); that is, body surfaces 68-71 are preferably concave and curved across substantially their entire widths to define a trough 84 on each of the four sides of body 66. Likewise, socket walls 78-81 are preferably convex and curved across substantially their entire widths to define projections 86 received into troughs 84. The preferred bowing of nose surfaces 68-71 and socket walls 78-81 across substantially their entire widths accentuate corners 67, 77 to provide increased resistance to the rotation of point 14 about base 12 during operation. The troughs and projections will also reduce rotational rattle of the point on the base. While the bowed surfaces 68-71 and walls 78-81 are preferred, other trough and projection configurations such as disclosed in U.S. patent application Ser. No. 11/706,582, which is incorporated herein by reference, could also be used. Other rotation resisting constructions could also be used.

The use of troughs 84 and projections 86, and particularly those that are gradually curved and extending substantially across the entire widths of the surfaces 68-71 and walls 78-81 eases the assembly of point 14 onto nose 18; i.e., the troughs 84 and projections 86 cooperatively direct point 14 into the proper assembled position on nose 18 during assembly. For example, if point 14 is initially installed on nose 18 out of proper alignment with the nose as it is fit onto the nose, the engagement of projections 86 being received into the troughs 84 will tend to rotate the point into proper alignment as the point is fed rearward onto nose 18. This cooperative effect of troughs 84 and projections 86 greatly eases and speeds installation and the setting of corners 67 into corners 77. Some variations could also be used between the shapes of the socket and the nose so long as the socket predominantly matches the shape of the nose.

Nose surfaces 68-71 with troughs 84 are each preferably inclined axially to expand outward as they extend rearward to provide strength to nose 18 until reaching a rear stabilizing surface 85 of nose 18. Likewise, socket walls 78-81 with projections 86 also each expand to conform to surfaces 68-71. Socket walls 78-81 also define rear stabilizing surfaces 95 to bear against stabilizing surfaces 85. Rear stabilizing surfaces 85, 95 are substantially parallel to longitudinal axis 28. In one preferred embodiment, each stabilizing surface 85, 95 diverges axially rearward at an angle to axis 28 of about 7 degrees. The rear stabilizing surfaces 85, 95 also preferably encircle (or at least substantially encircle) nose 18 and socket 20 to better resist non-axial loads. While contact between the various socket surfaces and the nose will likely occur during an excavating operation, contact between the corresponding front bearing surfaces 60, 64 and rear stabilizing surfaces 85, 95 is intended to provide primary resistance to the applied loads on the tooth and thereby provide the desired stability. While stabilizing surfaces 85, 95 are preferably formed with short axial extensions, they could have longer or different constructions. Also, in certain circumstances, e.g., in light duty operations, benefits can be achieved without stabilizing surfaces 85, 95.

Front bearing faces 60, 64 and rear stabilizing surfaces 85, 95 are provided to stabilize the point on the nose and to lessen stress in the components. The generally hemispherical bearing faces 60, 64 at the front ends 58, 62 of the nose 18 and socket 20 are able to stably resist axial and non-axial rearward forces in direct opposition to the loads irrespective of their applied directions. This use of curved, continuous front bearing surfaces reduces rattling of the point on the nose and reduces the stress concentrations that otherwise exist when corners are present. Rear stabilizing surfaces 85, 95 complement the front bearing faces 60, 64 by reducing the rattle at the rear of the point and providing stable resistance to the rear portions of the point, as described in U.S. Pat. No. 5,709,043 incorporated herein by reference, With stabilizing surfaces 85, 95 extending about the entire perimeter of nose 18 or at least substantially about the entire perimeter (FIGS. 7, 9 and 11-14), they are also able to resist the non-axially directed loads applied in any direction.

Figure 11:
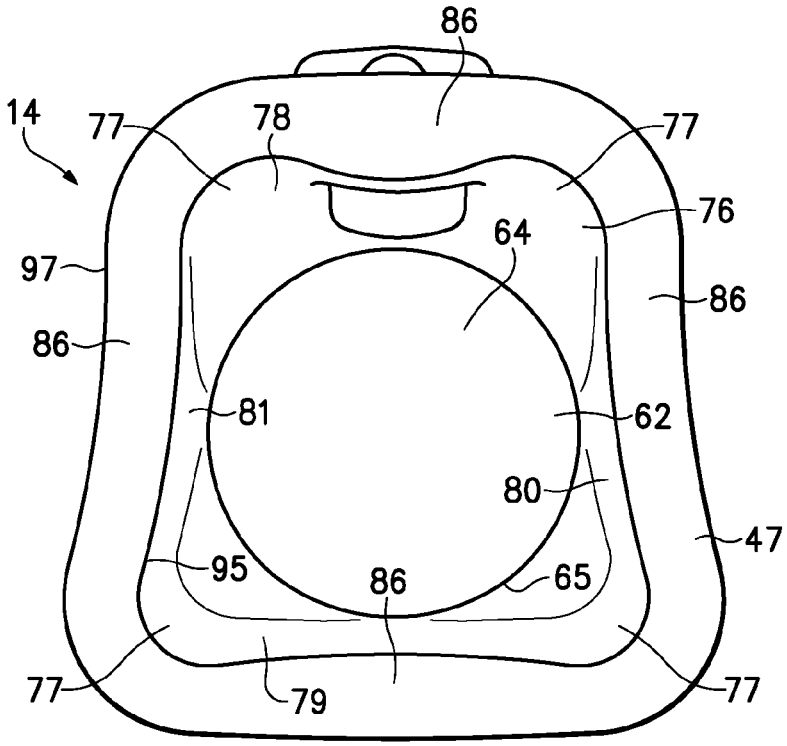
FIG. 11 is a rear view of the wear member.
Figure 12:
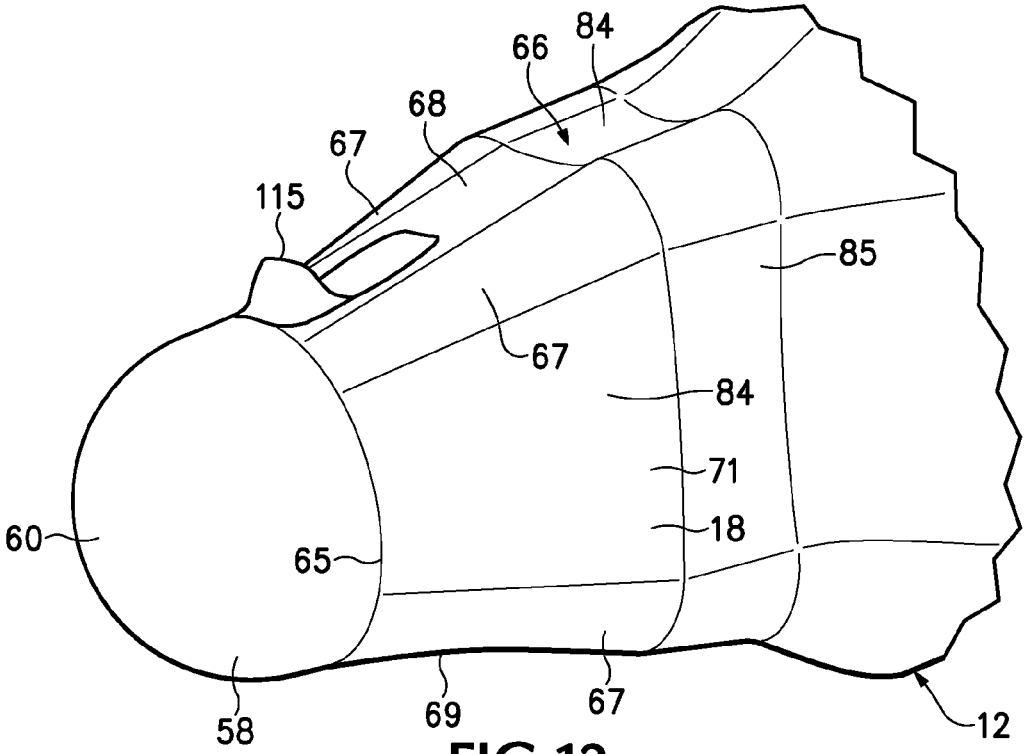
FIG. 12 is a perspective view of a nose of a base of the invention.
Figure 13:
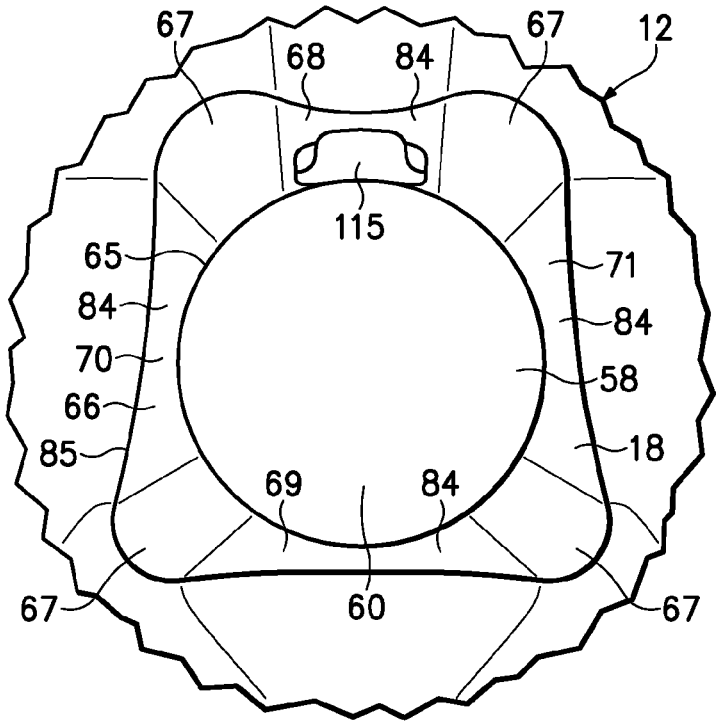
FIG. 13 is a front view of the nose.
Figure 14:
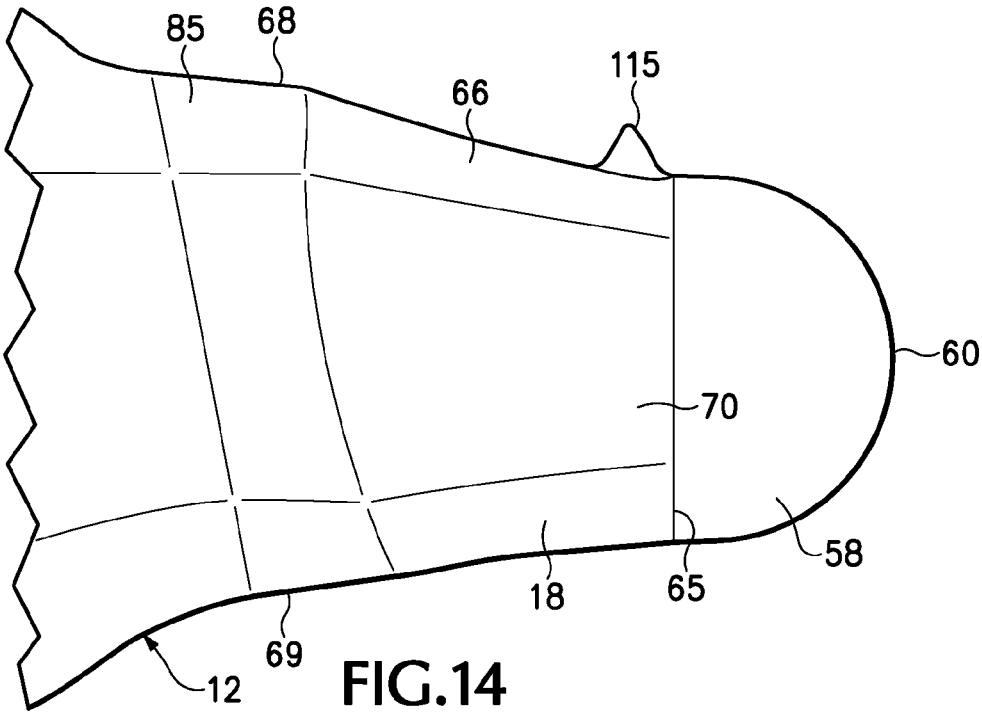
FIG. 14 is a side view of the nose.
Figure 15:
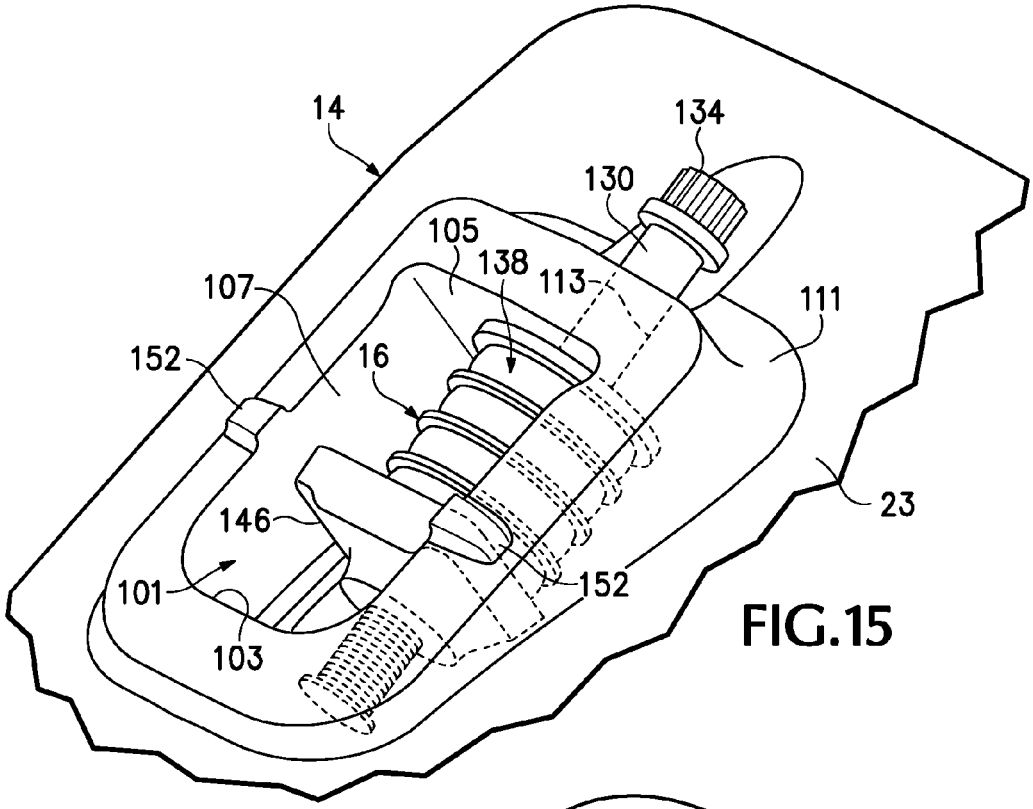
FIG. 15 is an enlarged perspective view of a lock in the wear assembly.
Figure 16:
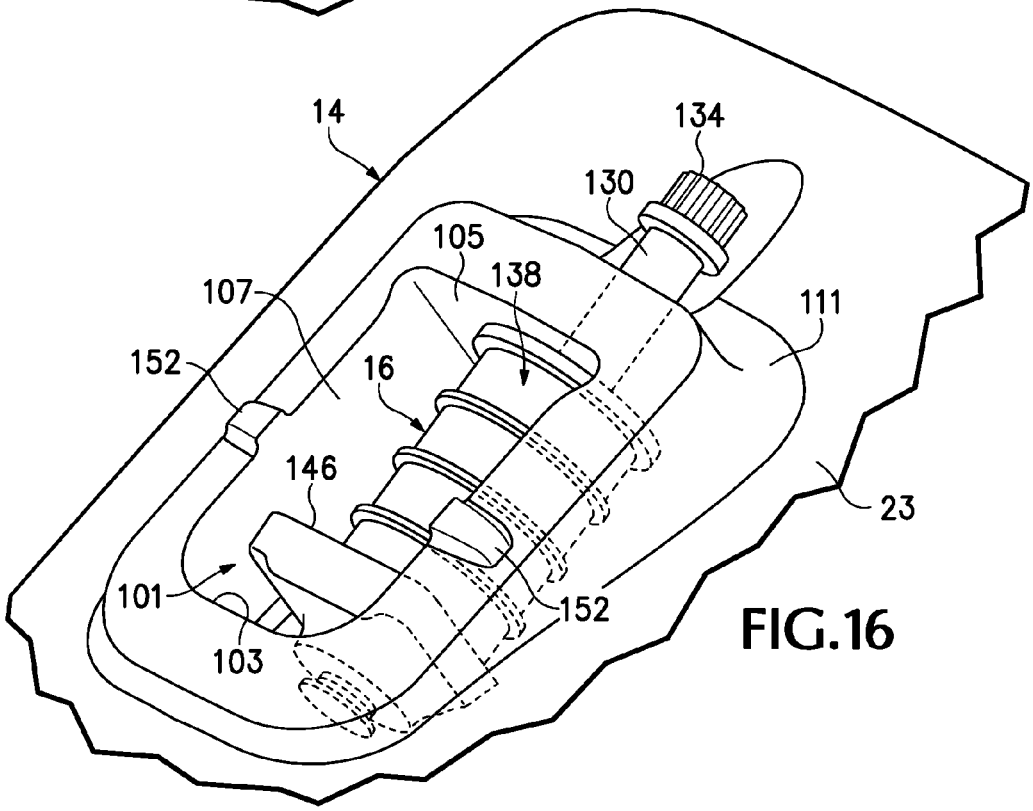
FIG. 16 is an enlarged perspective view of the lock in the wear assembly prior to tightening.
Figure 17:
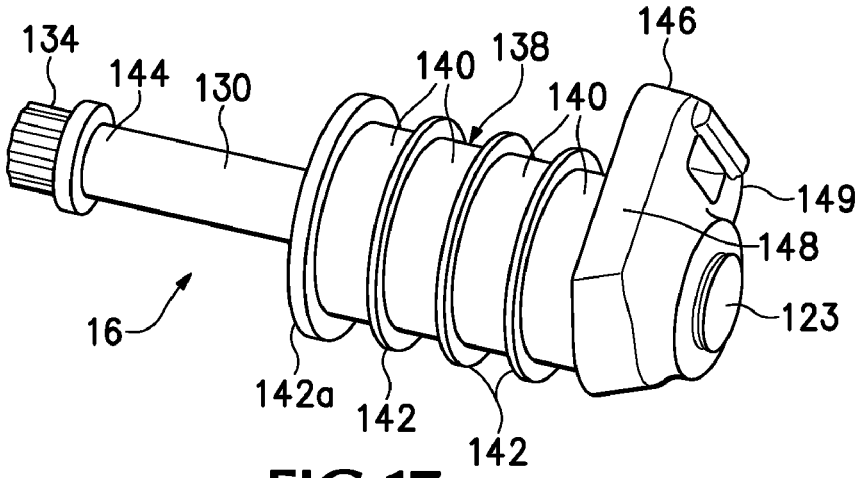
FIG. 17 is a perspective view of the lock.
Figure 18:
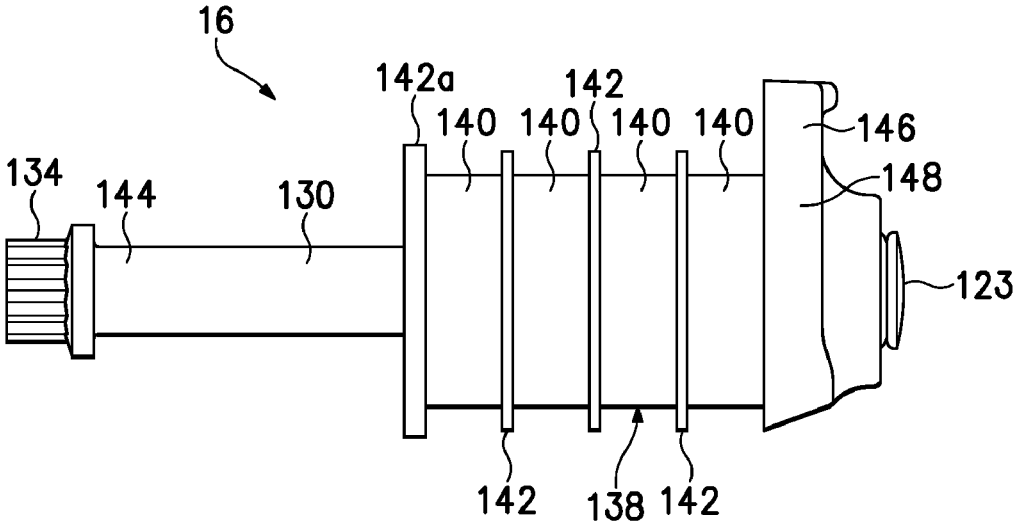
FIG. 18 is a side view of the lock.
Figure 20:
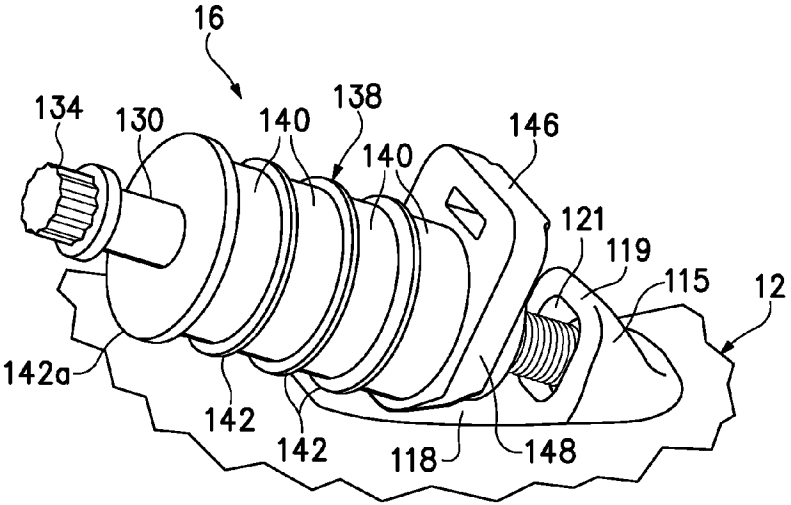
FIG. 20 is a perspective view of the lock with the nose (the point has been omitted).
Figure 19:
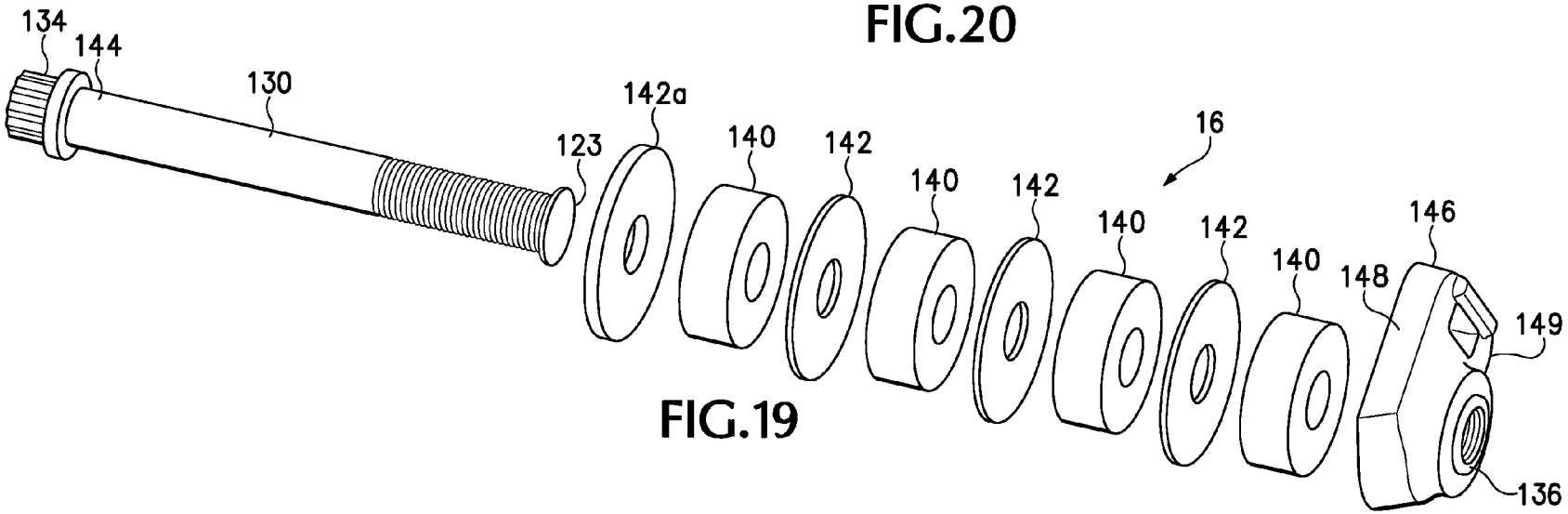
FIG. 19 is an exploded, perspective view of the lock.
Figure 21:
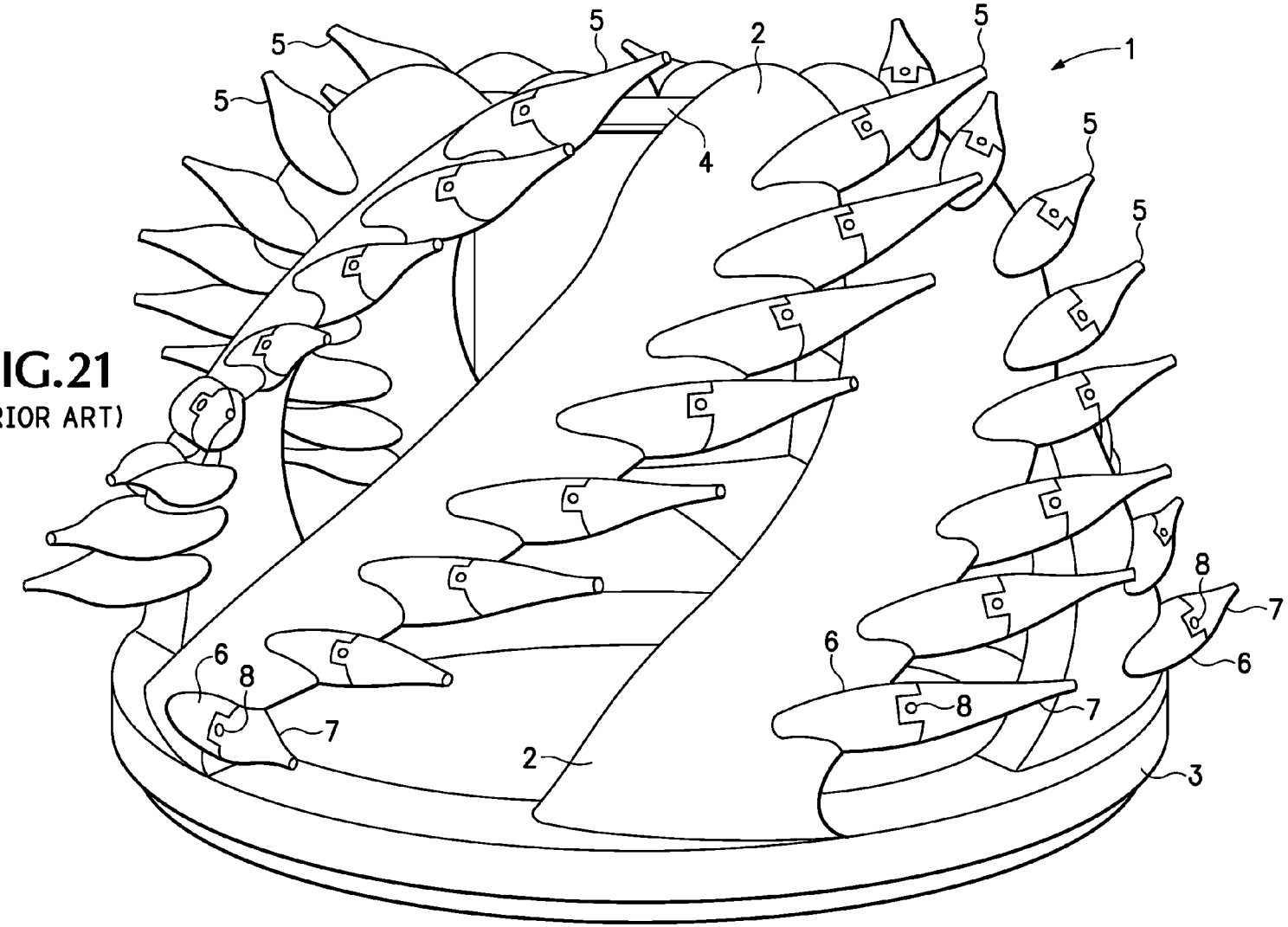
FIG.21 (PRIOR ART)
FIG. 21 is a side view of a conventional dredge cutterhead.

Main portion 76 of socket 20 preferably has a generally trapezoidal transverse configuration to receive a matingly shaped nose 18 (FIGS. 7 and 11). The generally trapezoidal transverse configuration of socket 20 generally follows the generally trapezoidal transverse configuration of the exterior 97 of point 14. This cooperative shaping of the socket 20 and exterior 97 maximizes the size of the nose 18 that can be accommodated within point 14, eases the manufacturing of point 14 in a casting process, and enhances the strength to weight ratio.

A wide variety of different locks can be used to releasably secure wear member 14 to base 12. Nonetheless, in a preferred embodiment, lock 16 is received into an opening 101 in wear member 14, preferably formed in trailing wall 27 though it could be formed elsewhere (FIGS. 1, 9 and 15-20). Opening 101 preferably has an axially elongated shape and includes a front wall 103, a rear wall 105, and sidewalls 107, 109. A rim 111 is built up around opening 101 for protection of the lock and for additional strength. Rim 111 is also enlarged along rear wall 105 to extend farther outward of exterior surface 97 and define a hole 113 for passage of lock 16. The hole stabilizes the position of lock 16 and permits easy access to it by the operator.

Nose 18 includes a stop 115 that projects outward from upper side 68 of nose 18 to engage lock 16. Stop 115 preferably has a rear face 119 with a concave, curved recess 121 into which a front end 123 of lock 16 is received and retained during use, but other arrangements could be used to cooperate with the lock. In a preferred construction, opening 101 is long enough and trailing wall 27 sufficiently inclined to provide clearance for stop 115 when wear member 14 is installed onto nose 18. Nevertheless, a relief or other forms of clearance could be provided in socket 20 if needed for the passage of stop 115. Further, the projection of stop 115 is preferably limited by the provision of a depression 118 to accommodate a portion of lock 16.

Lock 16 is a linear lock oriented generally axially to hold wear member 14 onto base 12, and to tighten the fit of wear member 14 onto nose 18. The use of a linear lock oriented axially increases the capacity of the lock to tighten the fit of the wear member on the nose; i.e., it provides for a greater length of take up. In a preferred embodiment, lock 16 includes a threaded shaft 130 having a front end 123 and a rear end with head 134, a nut 136 threaded to shaft 130, and a spring 138 (FIGS. 1, 9 and 15-20). Spring 138 is preferably formed of a series of elastomeric disks 140 composed of foam, rubber or other resilient material, separated by spacers 142 which are preferably in the form of washers. Multiple disks 140 are used to provide sufficient force, resiliency and take up. The washers isolate the elastomeric disks so that they operate as a series of individual spring members. Washers 142 are preferably composed of plastic but could be made of other materials. Moreover, the spring of the preferred construction is economical to make and assemble on shaft 130. Nevertheless, other kinds of springs could be used. A thrust washer 142*a* or other means is preferably provided at the end of the spring to provide ample support.

Shaft 130 extends centrally through spring 138 to engage nut 136. Front end 123 of shaft 130 fits into recess 121 so that the shaft 130 is set against stop 115 for support. Rear end 134 of lock 16 extends through hole 113 in wear member 14 to enable a user to access the lock outside of opening 101. The shaft is preferably set at an angle to axis 28 so that head 134 is more easily accessed. Spring 138 sets between rear wall 105 and nut 136 so that it can apply a biasing force to the wear member when the lock is tightened. Hole 113 is preferably larger than head 134 to permit its passage during installation of lock 16 into assembly 10. Hole 113 could also be formed as an open slot to accommodate insertion of shaft 130 simply from above. Other tool engaging structures could be used in lieu of the illustrated head 134.

In use, wear member 14 is slid over nose 18 so that nose 18 is fit into socket 20 (FIGS. 1 and 9). The lock can be temporarily held in hole 113 for shipping, storage and/or installation by a releasable retainer (e.g., a simple twist tie) fit around shaft 130 outside of opening 101 or it can be installed after the wear member is fit onto the nose. In any event, shaft 130 is inserted through hole 113 and its front end 123 set in recess 121 of stop 115. Lock 16 is positioned to lie along the exterior of nose 18 so that no holes, slots or the like need to be formed in the nose to contain the lock for resisting the loads. Head 134 is engaged and turned by a tool to tighten the lock to a compressive state to hold the wear member; i.e., shaft 130 is turned relative to nut 136 so that front end 123 presses against stop 115. This movement, in turn, draws nut 136 rearward against spring 138, which is compressed between nut 136 and rear wall 105. This tightening of lock 16 pulls wear member 14 tightly onto nose 18 (i.e., with front bearing faces 60, 64 engaged) for a snug fit and less wear during use. Continued turning of shaft 130 further compresses spring 138. The compressed spring 138 then urges wear member 14 rearward as the nose and socket begin to wear. The stability of the preferred nose 18 and point 14 enables the use of an axial lock, i.e., no substantial bending forces will be applied to the lock so that the high axial compressive strength of the bolt can be used to hold the wear member to the base. Lock 16 is lightweight, hammerless, easy to manufacture, does not consume much space, and does not require any openings in the nose.

In a preferred construction, lock 16 also includes an indicator 146 fit onto shaft 130 in association with nut 136 (FIGS. 15-20). Indicator 146 is preferably a plate formed of steel or other rigid material that has side edges 148, 149 that fit closely to sidewalls 107, 109 of opening 101, but not tightly into opening 101. Indicator 146 includes an opening that fully or partially receives nut 136 to prevent rotation of the nut when shaft 130 is turned. The close receipt of side edges 148, 149 to sidewalls 107, 109 prevents indicator 146 from turning. Alternatively, the indicator could have a threaded bore to function as the nut; if the indicator were omitted, other means would be required to hold nut 136 from turning. Indicator 146 could also be discrete from nut 136.

Indicator 146 provides a visual indication of when shaft 130 has been suitably tightened to apply the desired pressure to the wear member without placing undue stress on shaft 130 and/or spring 138. In a preferred construction, indicator 146 cooperates with a marker 152 formed along opening 101, e.g., along rim 111 and/or sidewalls 107, 109. Marker 152 is preferably on rim 111 along one or both sidewalls 107, 109, but could have other constructions. Marker 146 is preferably a ridge or some structure that is more than mere indicia so that it can be used to retighten lock 16 when wear begins to develop as well as at the time of initial tightening.

When shaft 130 is turned and nut 136 drawn rearward, indicator 146 moves rearward (from the position in FIG. 16) with nut 136 within opening 101. When indicator 146 aligns with marker 152 (FIG. 15), the operator knows that tightening can be stopped. At this position, lock 16 applies a predetermined pressure on wear member 14 irrespective of the wear on the nose and/or in the socket 20. Hence, both under-tightening and over-tightening of the lock can be easily avoided. As an alternative, indicator 146 can be omitted and shaft 130 tightened to a predetermined amount of torque.

The various aspects of the invention are preferably used together for optimal performance and advantage. Nevertheless, the different aspects can be used individually to provide the benefits they each provide.

The invention claimed is:

1. A wear member for excavating equipment comprising a working section and a mounting section generally aligned along a longitudinal axis, the mounting section including a socket for receiving a base fixed to the excavating equipment to mount the wear member on the excavating equipment, and the working section being that part of the wear member forward of the socket, a leading side adapted to be a forward surface during advance of the wear member through the ground during a digging operation, and a trailing side adapted to be a rearward surface during advance of the wear member through the ground, the leading and trailing sides extending axially across the working and mounting sections, and the leading side having a greater width than the trailing side in transverse cross sections perpendicular to the longitudinal axis along at least part of the working section and the mounting section.

2. A wear member in accordance with claim 1 including an opening for receiving a lock to secure the wear member to the base.

3. A wear member in accordance with claim 1 wherein the working section is an elongate bit.

4. A wear member in accordance with claim 1 wherein the mounting section has a generally trapezoidal transverse configuration perpendicular to the longitudinal axis.

5. A wear member in accordance with claim 4 wherein the working section has a generally trapezoidal transverse configuration perpendicular to the longitudinal axis.

6. A wear member in accordance with claim 4 wherein substantially the entire length of the mounting section has a generally trapezoidal transverse configuration perpendicular to the longitudinal axis.

7. A wear member in accordance with claim 1 wherein at least one wall of the socket is bowed inwardly to define a projection that fits into a trough formed on the base.

8. A wear member in accordance with claim 1 wherein the socket has a generally trapezoidal transverse configuration.

9. A wear member in accordance with claim 8 wherein each wall of the socket defining the trapezoidal shape has a generally curved, convex shape across substantially the entire width of the wall.

10. A wear member in accordance with claim 1 wherein the leading side has a greater width than the trailing side in transverse cross sections perpendicular to the longitudinal axis along substantially all of the working section.

11. A wear member in accordance with claim 1 wherein the socket includes an upper surface, a lower surface and sidewalls that are each bowed inwardly to be received into a trough formed on the base.

12. A wear member for excavating equipment comprising a working section and a mounting section generally aligned along a longitudinal axis, the mounting section including a socket for receiving a base fixed to the excavating equipment to mount the, wear member on the excavating equipment, and the working section being that part of the wear member forward of the socket, a leading side adapted to be a forward surface during advance of the wear member through the ground during a digging operation, a trailing side adapted to be a rearward surface during advance of the wear member through the ground, and sidewalls extending between the leading side and the trailing side, the leading side, the trailing side, and the sidewalls extending axially across the working and mounting sections, and the sidewalls generally converging toward the trailing side throughout at least a front end of the mounting section.

13. A wear member in accordance with claim 12 wherein the sidewalls generally converge toward the trailing side across substantially the entire length of the mounting section.

14. A wear member in accordance with claim 12 wherein the working section is an elongate bit.

15. A wear member in accordance with claim 12 including an opening for receiving a lock to secure the wear member to the base.

16. A wear member in accordance with claim 12 wherein the socket includes an upper surface, a lower surface and sidewalls that are each bowed inwardly to be received into a trough formed on the base.

17. A wear member in accordance with claim 12 wherein the sidewalls generally converge toward the trailing side along at least part of the working section.

18. A wear member in accordance with claim 12 wherein the sidewalls generally converge toward the trailing side along substantially the entire length of the working section.

19. A wear member for excavating equipment comprising a working section and a mounting section generally aligned along a longitudinal axis, the mounting section including a socket for receiving a base fixed to the excavating equipment to mount the wear member on the excavating equipment, the socket including a front end and a main portion rearward of the front end, wherein the front end has a front bearing surface generally transverse to the longitudinal axis, and the main portion of the socket and an external surface of the mounting section each has a generally trapezoidal configuration transverse to the longitudinal axis.

20. A wear member in accordance with claim 19 wherein the socket has upper, lower and side surfaces that are bowed inwardly across substantially their entire widths.

21. A wear member in accordance with claim 19 wherein the front bearing surface in the front end of the socket is generally hemispherical.

22. A wear member in accordance with claim 19 including an opening for receiving a lock to secure the wear member to the base.

23. A wear member in accordance with claim 19 wherein the socket includes an upper surface, a lower surface and sidewalls that are each bowed inwardly to be received into a trough formed on the base.

24. A wear member in accordance with claim 19 wherein the socket and the external surface of the mounting section each has a generally trapezoidal configuration transverse to the longitudinal axis at substantially any point along the entire length of the socket and mounting section.

25. A wear member in accordance with claim 19 wherein the leading side has a greater width than the trailing side in transverse cross sections perpendicular to the longitudinal axis along at least the front end of the mounting section.

26. A wear assembly for excavating equipment comprising:

a base fixed to the excavating equipment;

a wear member including a working section and a mounting section generally aligned along a longitudinal axis, the mounting section including a socket for receiving a base fixed to the excavating equipment to mount the wear member on the excavating equipment, and the working section being that part of the wear member forward of the socket, the working section including a front end to generally initiate contact with earthen material to be excavated, a leading side adapted to be a forward surface during advance of the wear member through the ground during a digging operation, and a trailing side adapted to be a rearward surface during advance of the wear member through the ground, the leading and trailing sides extending axially across the working and mounting sections, and the leading side having a greater width than the trailing side in transverse cross sections perpendicular to the longitudinal axis along at least part of the working section and the mounting section; and a lock to releasably secure the wear member to the base.

27. A wear assembly in accordance with claim 26 wherein the base includes a nose received into the socket, and wherein the nose and the socket each has a generally trapezoidal transverse configuration perpendicular to the longitudinal axis.

28. A wear assembly in accordance with claim 26 wherein the base includes a nose received into the socket, the nose includes a plurality of troughs, and the socket includes a plurality of projections received into the troughs.

29. A wear assembly in accordance with claim 26 wherein the base includes an upper surface, a lower surface and sidewalls that each define a trough, and the socket in the wear member includes an upper surface, a lower surface and sidewalls that are each bowed inwardly to be received into one of the troughs formed on the base.

30. A wear assembly in accordance with claim 29 wherein the base includes a mounting portion adapted for attachment to an arm of a dredge cutterhead.

31. A wear assembly in accordance with claim 26 wherein the base includes a mounting portion adapted for attachment to an arm of a dredge cutterhead.

32. A wear assembly for excavating equipment comprising:

a base fixed to the excavating equipment;

a wear member including a working section and a mounting section generally aligned along a longitudinal axis, the mounting section including a socket for receiving a base fixed to the excavating equipment to mount the wear member on the excavating equipment, and the working section being that part of the wear member forward of the socket, a leading side adapted to be a forward surface during advance of the wear member through the ground during a digging operation, a trailing side adapted to be a rearward surface during advance of the wear member through the ground, and sidewalls extending between the leading side and the trailing side, the leading side, the trailing side, and the sidewalls extending axially across the working and mounting sections, and the sidewalls generally converging toward the trailing side throughout at least a front end of the mounting section; and a lock for releasably securing the wear member to the base.

33. A wear assembly in accordance with claim 32 wherein the base includes an upper surface, a lower surface and sidewalls that each define a trough, and the socket in the wear member includes an upper surface, a lower surface and sidewalls that are each bowed inwardly to be received into one of the troughs formed on the base.

34. A wear assembly in accordance with claim 33 wherein the base includes a mounting portion adapted for attachment to an arm of a dredge cutterhead.

35. A wear assembly in accordance with claim 32 wherein the base includes a mounting portion adapted for attachment to an arm of a dredge cutterhead.

36. A wear assembly in accordance with claim 32 wherein the sidewalls of the wear member generally converge toward the trailing side along at least part of the working section.

37. A wear assembly in accordance with claim 32 wherein the sidewalls generally converge toward the trailing side along substantially the entire length of the working section.

38. A wear assembly in accordance with claim 37 wherein the base includes a mounting portion adapted for attachment to an arm of a dredge cutterhead.

39. A wear assembly for excavating equipment comprising:

a base fixed to the excavating equipment;

a wear member including a working section and a mounting section generally aligned along a longitudinal axis, the mounting section including a socket for receiving the base to mount the wear member on the excavating equipment, the socket including a front end and a main portion rearward of the front end, wherein the front end has a front bearing surface generally transverse to the longitudinal axis, and the main portion of the socket and the mounting section each has a generally trapezoidal configuration transverse to the longitudinal axis; and a lock for releasably holding the wear member to the base.

40. A wear assembly in accordance with claim 39 wherein the base includes a nose which has a generally trapezoidal configuration transverse to the longitudinal axis to substantially conform to the shape of the socket.

41. A wear assembly in accordance with claim 39 wherein the base includes an upper surface, a lower surface and sidewalls that each define a trough, and the socket in the wear member includes an upper surface, a lower surface and sidewalls that are each bowed inwardly to be received into one of the troughs formed on the base.

42. A wear assembly in accordance with claim 39 wherein the base includes a mounting portion adapted for attachment to an arm of a dredge cutterhead.

43. A wear assembly in accordance with claim 39 wherein the socket and the external surface of the mounting section each has a generally trapezoidal configuration transverse to the longitudinal axis at substantially at point along the entire length of the socket and mounting section.

44. A wear assembly in accordance with claim 39 wherein the leading side has a greater width than the trailing side in transverse cross sections perpendicular to the longitudinal axis along at least the front end of the mounting section.

* * * * *